US006873674B2

(12) United States Patent
Gonzalez

(10) Patent No.: US 6,873,674 B2
(45) Date of Patent: Mar. 29, 2005

(54) PAPER CURRENCY COUNTER WITH EMERGENCY STOP FEATURES

(76) Inventor: Rolando Gonzalez, 7104 SW. 50th St., Miami, FL (US) 33166

( * ) Notice: Subject to any disclaimer, the term of this patent is extended or adjusted under 35 U.S.C. 154(b) by 0 days.

(21) Appl. No.: 10/454,943

(22) Filed: Jun. 5, 2003

(65) Prior Publication Data

US 2004/0247068 A1 Dec. 9, 2004

(51) Int. Cl.[7] ..... G06M 11/00
(52) U.S. Cl. ..... 377/8
(58) Field of Search ..... 377/8

(56) References Cited

U.S. PATENT DOCUMENTS 1,159,826 A 11/1915 Buckley
1,328,263 A 1/1920 Buckley et al.
2,271,394 A 1/1942 Hayes
2,494,615 A 1/1950 Hayes
3,025,771 A 3/1962 Uchida
3,214,096 A 10/1965 Buchholz et al.
3,983,367 A 9/1976 Kondo et al.
4,275,874 A 6/1981 DiBlasio
4,504,916 A 3/1985 Oka
4,905,839 A 3/1990 Yuge et al.
4,905,840 A 3/1990 Yuge et al.
5,696,802 A 12/1997 Hafezan
5,745,540 A 4/1998 Okada et al.
6,324,237 B1 11/2001 Price et al.
6,370,216 B1 4/2002 Lawandy et al.

*Primary Examiner*—Margaret R. Wambach
(74) *Attorney, Agent, or Firm*—Lott & Friedland, P.A.

(57) ABSTRACT

A friction roller paper currency counter. Specifically, the paper currency counter of the present invention incorporates electronic circuitry which automatically stops the mechanical motors in the event a foreign object is accidentally ingested by the counter.

8 Claims, 3 Drawing Sheets

PAPER CURRENCY COUNTER WITH EMERGENCY STOP FEATURES

FIELD OF INVENTION

The present invention relates generally to the field of a friction roller paper currency counters. Specifically, the paper currency counter of the present invention incorporates electronic circuitry which automatically stops the mechanical motors in the event a foreign object is accidentally ingested by the counter.

BACKGROUND OF THE INVENTION

Currency and document handling and counting apparatus find wide-spread use such as, for example, in banks and other commercial as well as industrial establishments and in institutions wherein it is desired to count large stacks of sheets which may include, for example, coupons, bank checks, paper currency and the like. It is important to provide apparatus capable of accurately counting and stacking such sheets at high rates of speed.

Paper currency counting equipment is designed to replace the time consuming manual tasks of counting a quantity of bills, of subdividing a quantity of bills into batches, each containing a preselected number of bills, and of certifying the count of a trap of bills. Accuracy is, of course, a primary requirement of operation of paper currency counters.

Previous attempts have been made to provide a paper currency counter machine such as described in U.S. Pat. No. 6,370,216 to Lawandy et al. ('216 patent); U.S. Pat. No. 6,324,237 to Price et al. ('237 patent); U.S. Pat. No. 5,745,540 to Okada et al. ('540 patent); U.S. Pat. No. 5,696,802 to Hafezan ('802 patent); U.S. Pat. No. 4,905,839 to Yuge et al. ('839 patent); U.S. Pat. No. 4,905,840 to Yuge et al. ('840 patent); U.S. Pat. No. 4,504,916 to Oka ('916 patent); U.S. Pat. No. 4,275,874 to DiBlasio ('874 patent); U.S. Pat. No. 3,983,367 to Kondó et al. ('367 patent); U.S. Pat. No. 3,214,096 to Buchholz et al ('096 patent); U.S. Pat. No. 3,025,771 to Uchida ('771 patent); U.S. Pat. No. 2,494,615 to Hayes ('615 patent); U.S. Pat. No. 2,271,394 to Hayes ('394 patent); U.S. Pat. No. 1,328,263 to Buckley et al. ('263 patent); and, U.S. Pat. No. 1,159,826 to Buckley et al ('826 patent) all of which are incorporated herein by reference.

The '216 patent describes a method and system for detecting a presence of more than one item at a point along a conveyance path, comprising steps of (A) generating a light beam and directing the beam through the path such that a presence of the item will cause the beam to be attenuated; (B) detecting the beam after it is attenuated by the presence of the item; and (C) determining from the amount of attenuation how many items are simultaneously present. In the preferred embodiment the item is an item of currency, and the step of generating a light beam includes a step of operating an optical source, such as an LED or a laser, to generate a beam having a wavelength in the range of about 400 nm to about 1 micrometer or longer.

The '237 patent describes a sheet counting apparatus comprising a sheet support for holding a stack of sheets to be counted. A sheet feed device moves the sheets individually from a first position to a second position while they remain held together in the stack. A counter monitors movement of the sheet as it is moved from the first position to the second position, and increments a count when such movement is detected.

The '540 patent describes a bill counter which comprises a case body formed to be a size which can be carried; a display section provided on the surface of the case body; an insertion port provided on one side of the case body which is capable of being expanded/contracted; a taking-out port provided on the other side of the case body; a first feeding-out device which is provided on the insertion port side within the case body and feeds out bills in a bundle inserted to the insertion port by a few sheets; a second feed-out device which is provided on the taking-out port side within the case body and feeds out bills one by one fed out by the first feeding-out device; a driving section which drives simultaneously the first and the second feeding-out devices; an identifying sensor which identifies bills going toward the taking-out port; and a control section which outputs a signal displaying the number of sheets by unit of each bill and the total amount at least to said display section based on the signal from the identifying sensor and a signal which stops the operation of the driving section when a forged bill is detected.

The '802 patent describes a counter for counting the number of sheets in a stack having a rotor which engages in an edge region of the stack and transfers sheets one at a time from one side of the rotor to the other upon rotor rotation. The rotor is mounted on a shaft carried by a carriage arranged for sliding movement on guides. A motor drives a lead screw, whereby the carriage is driven along the guides. The rotor may float on its shaft and its position is sensed by detector; the output of the detector is used to control motor whereby the carriage is driven substantially continuously and smoothly at a rate appropriate for a counting operation being performed.

The '839 patent describes a banknote account and arrangement apparatus, which includes a supply portion for supplying a group of banknotes in the apparatus one after another, a discrimination circuit for discriminating denomination, face, fitness, authenticity, and the like of the supplied banknotes, temporary stackers in which the banknote is stacked in an account mode, closed cassettes coupled to the temporary stackers, open pockets in which the banknote is stacked in an arrangement mode, a RAM for collecting data of the banknote stacked in the temporary stackers, a CPU for verifying the collected data of the banknote stacked in the temporary stackers with known data of the bundle of the banknotes, pushers and shutters for, only when a verification result is correct, stacking the banknote stacked in the temporary stackers in the closed cassettes, and a display portion for displaying the collected data. When an interruption command is input in the account mode, data collection is temporarily interrupted, and an operation in the arrangement mode is performed using the open pockets while storing the collected data.

The '840 patent describes a banknote account and arrangement apparatus including a supply portion for supplying a bundle of banknotes in the apparatus one after another, a discrimination circuit for discriminating denomination, face, fitness, authenticity, and the like of the supplied banknotes, temporary stackers in which the banknote is stacked in an account mode, closed cassettes coupled to the temporary stackers, open pockets in which the banknote is stacked in an arrangement mode, a RAM for collecting data of the banknote stacked in the temporary stackers, a CPU for verifying the collected data of the banknote stacked in the temporary stackers with known data of the bundle of the banknotes, pushers and shutters for, only when a verification result is correct, stacking the banknote stacked in the temporary stackers in the closed cassettes, and a display portion for displaying the collected data. Sensors detect if the temporary stackers are full. When the sensors detect that the temporary stackers are full in the account mode, a stacking destination of the paper money is changed to the open pockets while continuously collecting the data. After the temporary stackers are replaced with empty ones, the banknote stacked in the open pockets are stacked in the temporary stackers without collecting the data.

The '916 patent describes a paper sheet counting machine for feeding paper sheets, one at a time, and counting the number of the paper sheets, includes a circuit for detecting an abnormal flow of the paper sheets. In the circuit, the lengths of paper sheets are detected. A predetermined number of the detected signals are averaged. The newest length value is compared with the averaged value to provide a difference signal which determines whether an abnormal flow of the paper sheet has occurred. The averaged value is renewed to compensate for deviation of the length values.

The '874 patent describes a stacker for handling and counting documents such as, for example, paper sheets, paper currency and the like in which the documents are fed from an input tray through cooperative feeder and stripper assemblies which separate the documents to feed them in a one at a time fashion in a forward feed direction toward acceleration rollers which accelerate the single-fed documents to create a gap between documents moving along the feed path. A gap detector senses the presence of gaps for document counting purposes. An endorser and/or suspect examination detector for examining the authenticity of paper currency may be provided downstream of the first acceleration rollers. The stacker comprises second acceleration rollers cooperating with a guide plate which reverses the direction of movement of the paper documents passing through the endorser station to further accelerate the documents and urge them along a convex guide path and into the pockets of a document receiving stacker wheel assembly which delivers the documents to a stacker tray positioned substantially beneath the infeed stacker to facilitate removal and handling of stacked documents. The machine described by this patent discloses features which automatically halt the machine when it detects counterfeit currency or when it detects that bills have been double fed.

The '367 patent describes a sheet counting machine which has a sheet counting mechanism which is controlled through a coincidence detecting circuit operating to compare a number of sheets counted with a predetermined number of sheets. The coincidence detecting circuit is provided with a mode changing switch and an inverter connected thereto in the output path to relatively reverse a logical level of an output of the coincidence detecting circuit stop mode. The logical level thus relatively reversed is utilized for controlling the operation of the mechanism through switching elements and relay elements. The machine described by this patent discloses features which automatically halt the machine when a predetermined count has been reached.

The '096 patent relates to paper currency counting machines, and particularly to a paper currency counter having a central counting section, a compartment for receiving bills as a stack, and a delivery compartment for receiving counted bills, with means for removing bills singly from the stack, feeding the bills through the counting section, and conveying counted bills into the delivery compartment without danger of mutilation of bills and with assurance that each bill conveyed to the delivery compartment will be counted, together with selectable predetermined count means responsive to the passage of bills through the counting section and adapted to halt the flow of bills to the counting section upon the completion of the selected predetermined count. The currency counter described by this patent includes an "off" switch which immediately halts the operation of its motor upon being depressed.

The '771 patent describes an apparatus for counting bank notes and other similar articles. When bank notes in a pile are fed into a rotary drum having a coefficient of friction much greater than that of the bank notes to be counted and a pressing element having a coefficient of friction smaller than that of the drum but greater than that of the bank notes, the bank notes are caught by the drum one by one from the bottom of the pile and are advanced.

The '615 patent relates to roller-type paper money counting machines, and more particularly to an improved bill-callipering mechanism for use with same. The paper money counting machine described by this patent includes features which automatically halt the machine when it detects that multiple bills have stuck together.

The '394 patent describes a machine for assorting and counting paper money. The counting machine has a generally rectangular form and is divided from front to back by a number of partitions adapted to collecting paper money.

The '263 patent describes a machine for assorting and counting paper money, and is an improvement of the '826 patent. The '263 patent introduces a means to arrest the feeding means when more than one bill is introduced at the same time.

The '826 patent describes a machine for assorting and counting paper money. The machine is adapted to count bills one at a time and is comprised of a feeding means, an electric circuit adapted to be opened and closed by the feeding means, and an operating means for the counter included in the electric circuit.

None of the devices mentioned above describe a paper currency counter which incorporates electronic circuitry to automatically stop the mechanical motor in the event a foreign object is accidentally ingested by the counter.

Consequently, there is a need in the art for a paper currency counting machine that can automatically stop operation in the event of an inadvertent blockage.

SUMMARY OF THE INVENTION

Generally described, the present invention provides a paper currency counter which incorporates electronic circuitry which automatically stops the mechanical motors in the event a foreign object is accidentally ingested by the counter.

In a preferred embodiment of the invention, what is provided is an apparatus for counting paper currency, comprising: a means for feeding the apparatus; a paper currency transport means; a counting means; sensors for detecting input and output status; a receiving means; and, an automatic safety feature; whereby the automatic safety feature utilizes input and output status data to adjust apparatus speed.

In an alternate embodiment, what is provided is an apparatus for counting paper currency, comprising: a feeding tray; a feeding tray optical sensor, whereby the feeding tray optical sensor signals when the paper currency is waiting to be counted; a paper currency transport means, whereby the transport means is activated when the feeding tray optical sensor signals that the paper currency is waiting to be counted; a counting sensor; a speed sensor, whereby the speed sensor signals output data to the apparatus; a currency organizing means; a receiving tray; and, an automatic safety feature; whereby the automatic safety feature utilizes input from the feeding tray optical sensor and the speed sensor to determine operational status of the apparatus.

Accordingly, it is an object of the present invention to provide a paper currency counting machine that can automatically stop operation in the event of an inadvertent blockage.

DETAILED DESCRIPTION OF THE PREFERRED EMBODIMENT

Figure 1:
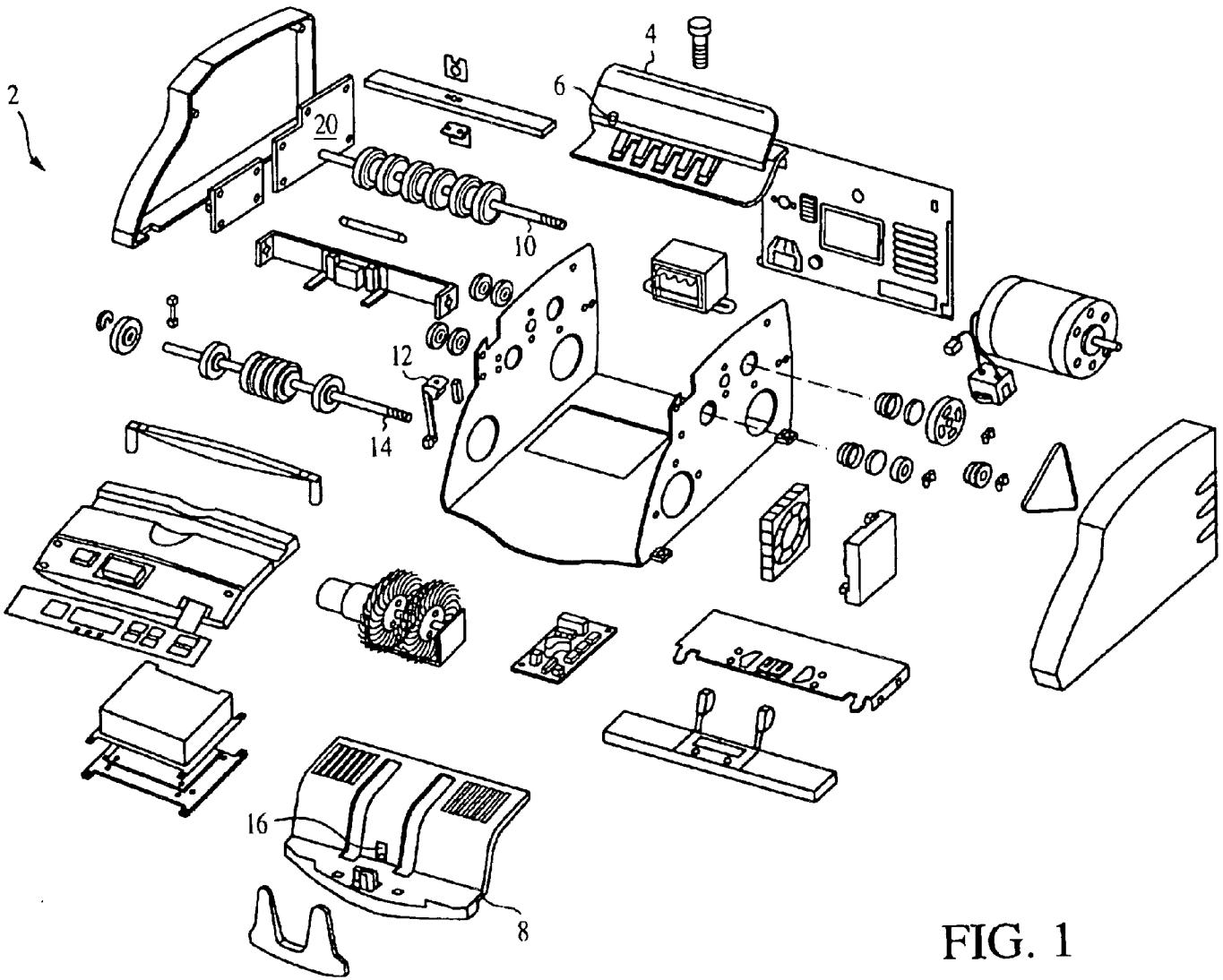
FIG. 1 is a perspective view of a preferred embodiment of the paper currency counter.

Referring initially to FIG. 1 of the drawings, in which like numerals indicate like elements throughout the several views, in a preferred embodiment the paper currency counting machine 2 is depicted. The counting machine 2 is provided with a feeding tray 4 which in turn accommodates an optical sensor, the Bank Note Drop Sensor ("BNDS") 6. Located within the counting machine 2 housing are a system of pulleys and belts, and 2 axles. These are used for transporting the paper currency through the machine during counting and eventually to the receiving tray 8.

Frictional pulling of paper currency from the feeding tray 4 through the counting machine 2 towards the receiving tray 8 is commenced when the BNDS 6 detects that paper currency has been placed in the feeding tray 4. The first axle 10 is used to pull paper currency from the feeding tray through the machine and past a system of counting sensors 12. The first axle 10 has a plurality of rubber rollers located thereon, to facilitate the pulling of the paper currency through the machine 2, the rollers preferably have a treaded surface. This counting system 12 is comprised of a light emitting diode ("LED") and a phototriode, located opposite of each other at the second axle 14. The second axle 14 has a plurality of rubber rollers located thereon, the rollers preferably having a smooth surface.

As an individual bill of paper currency moves through the machine 2 and over the second axle 14, the bill interrupts the beam of light that passes between the LED and the phototriode. Each interruption is registered by the machine 2 as being one bill of currency, and advances the count by one (the display 26 can be seen in FIG. 2). The paper currency that passes through the machine must pass a final LED/phototriode system 16 after passing over the second axle 14. This system 16 is called the Speed Rotational Sensor ("SRS"). The SRS 16 is used to set the overall speed of the machine by signaling to the control electronics 20 if the machine is moving too rapidly or too slowly. Should the SRS signal the control electronics 20 of a need to change speeds, the control electronics 20 will slow down or speed up the first axle 10, and therefore the overall intake speed. Once the counted bills pass the SRS 16, they fall towards the receiving tray 8 where a series of blades, driven by a separate motor as the counting machine 2, places the bills on the receiving tray 8 in an organized fashion.

The machine is equipped with an Automatic Safety Feature ("ASF") 22. In the event that an extraneous object falls into, or gets pulled into, the counting machine 2, the machine will start because the BNDS 6 has been triggered. However, not all objects that fall into the counting machine 2 will make it all the way through, a necktie for example. If the BNDS 6 signals a start of the machine, and the SRS 16 does not receive a necessary and correlative output signal, then the control electronics 20 indicate an operational error and stop the counting machine 2. An additional measure of protection can be provided by using a manual stop button in conjunction with the present invention.

Figure 2:
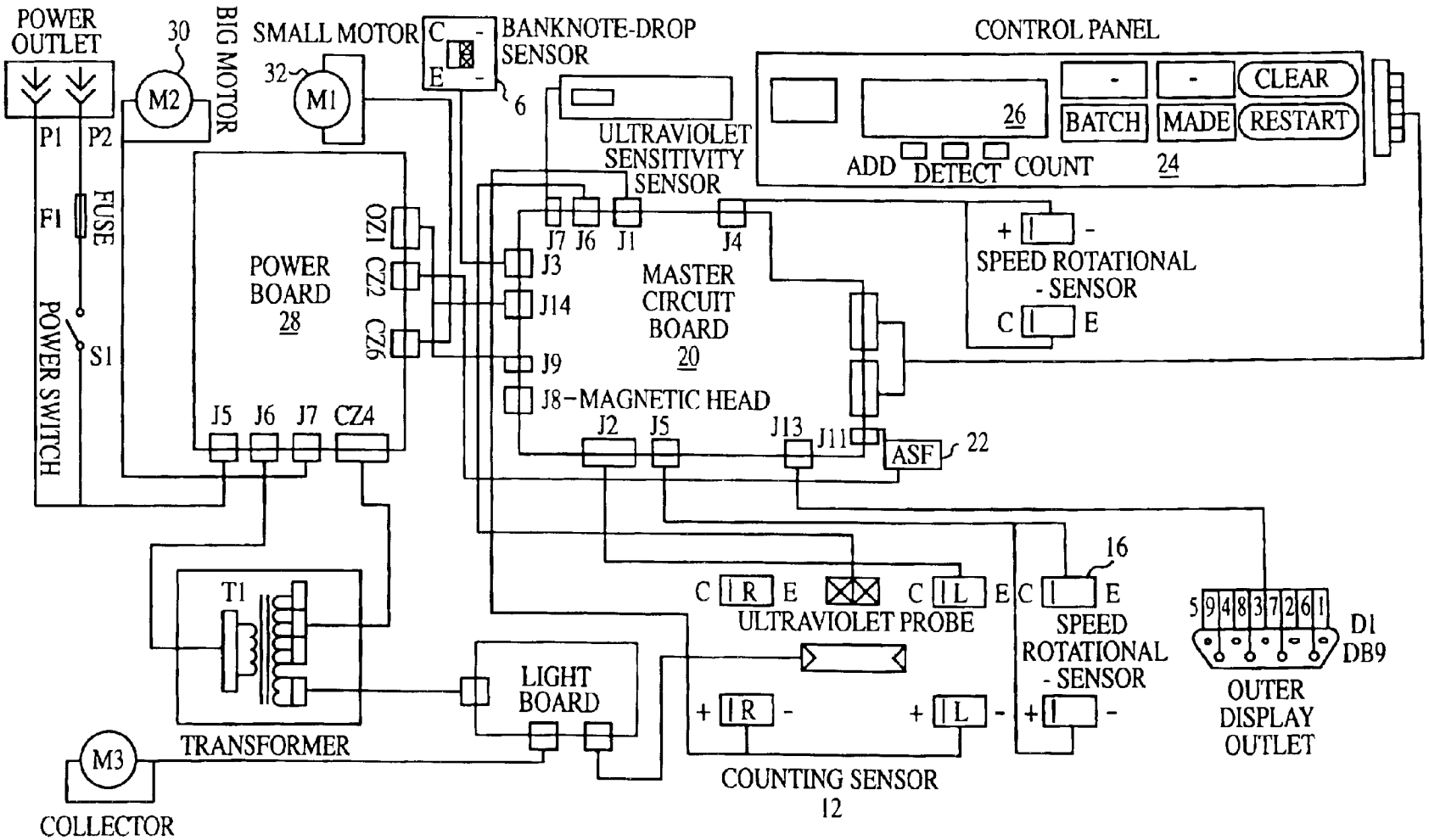
FIG. 2 is a block diagram of a preferred embodiment of the paper currency counter.

Referring now to FIG. 2, in a preferred embodiment a block diagram of the paper currency counting machine indicates the operational relationships of the critical systems in the counting machine 2. The motor 30 indicated as M2 drives the first axle 10. A secondary motor 32, indicated as M1, operates the second axle 14. The BNDS 6 is shown just to the right of the secondary motor 32. The counting sensor system 12 is depicted in the lower center of FIG. 2, while the SRS 16 is just a little above and to the right of the counting center system 12. The ASF 22 can be seen just to right of center. These critical components: the motors 30 and 32, the BNDS 6, the counting sensor system 12, the SRS 16, and the ASF 22 are all operationally connected to the control electronics 20, which is directly in the center of FIG. 2. Also of note is the user control panel 24, which allows a user to perform carious command functions and also receive the currency count on the display 26. The rest of the systems depicted in FIG. 2 enable the operation of the machine and are known to those of ordinary skill in the art.

Figure 3:
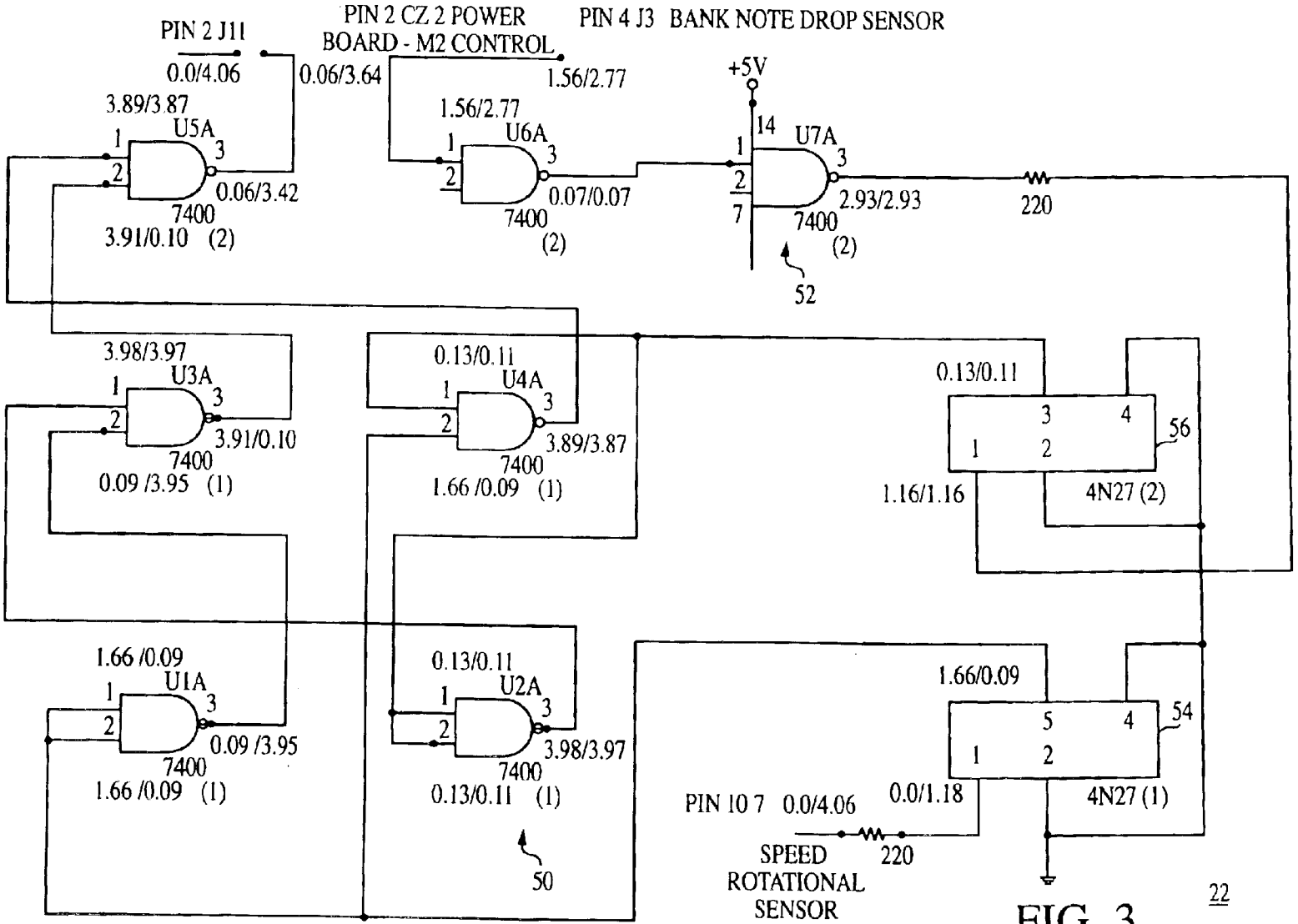
FIG. 3 is a circuit diagram of a preferred embodiment of the Automatic Safety Feature of the paper currency counter.

It should be noted that the instant invention utilizes off-the-shelf electronic components and that custom made, optimized circuits could be used in lieu of those depicted in FIG. 3. FIG. 3 depicts the off-the-shelf circuitry of the ASF 22 in more detail. The ASF 22 is comprised of a circuit having two chips of type DM7400 50, 52 (produced by Fairchild Semiconductor, S. Portland, Me.). Each of these chips contains four logical NAND gates. Two opto-coupler chips of type 4N27 54, 56 (produced by Isocom, Allen, Tex.) also form part of the circuit. As discussed above, the ASF 22 receives signals from two different locations on the machine. The first is the BNDS 6 and the second is the SRS 16. The BNDS 6 signal is applied to one of the input gates of the second DM7400 52 through pin 4. When the machine is at rest, the voltage at this input gate is 1.56 V. When there are bills in the feeding tray 4, the voltage increases to 2.77V. However, the resulting voltage at the output gate of DM7400 52 remains stable. This output voltage is applied to the diode of the opto-coupler 56 through pin 1 of the DM7400 52. The signal from the BNDS 6 allows the system to remain stable so that the primary motor 30 can function.

The signal from the SRS 16 is processed and applied to pin 10 of U7, located on the SRS 16 circuitry, from here the signal is applied to opto-coupler 54 at the ASF 22. This current activates the 4N27 chip 54 and a signal is transmitted to the DM7400 50 where it is processed and is integrated to the circuit making it active and passing a signal to pin 2 of CZ2 on the power board 28 (FIG. 2). CZ2 controls the power to the primary motor 30. If the signal from the SRS 16 is interrupted, the circuit is open and no current is allowed through J7, also on the power board 28, to the primary motor 30, causing it to stop. Once the ASF 22 has successfully stopped the operation of the machine, the obstruction can be cleared and operation resumed thereafter.

Accordingly, it will be understood that the preferred embodiment of the present invention has been disclosed by way of example and that other modifications and alterations may occur to those skilled in the art without departing from the scope and spirit of the appended claims.

What is claimed is:

1. An apparatus for counting paper currency, comprising:

a means for feeding said apparatus;

a paper currency transport means;

a counting means;

sensors for detecting objects input into said apparatus and output from said apparatus;

a receiving means; and, an automatic safety feature; whereby said automatic safety feature adjusts apparatus speed based on object detection data from said input sensor and said output sensor.

2. The apparatus of claim 1, wherein said apparatus also includes a currency organizing component.

3. The apparatus of claim 1, wherein said output sensor transmits output data to said apparatus.

4. An apparatus for counting paper currency, comprising:

a feeding tray;

a feeding tray optical sensor, whereby said feeding tray optical sensor signals when said paper currency is waiting to be counted;

a paper currency transport means, whereby said transport means is activated when said feeding tray optical sensor signals that said paper currency is waiting to be counted;

a counting sensor;

a speed sensor, whereby said speed sensor signals output data to said apparatus;

a currency organizing means;

a receiving tray; and, an automatic safety feature; whereby said automatic safety feature utilizes input from said feeding tray optical sensor and said speed sensor to determine operational status of said apparatus.

5. The apparatus of claim 4, wherein said apparatus also includes a manual stop button.

6. An apparatus for counting paper currency, comprising:

a means for feeding said apparatus, wherein said means for feeding includes a feeding tray optical sensor said feeding tray optical sensor signaling when said paper currency is waiting to be counted;

a paper currency transport means;

a counting means;

sensors for detecting objects input into said apparatus and output from said apparatus;

a receiving means; and, an automatic safety feature; whereby said automatic safety feature adjusts apparatus speed based on object detection data from said input sensor and said output sensor.

7. The apparatus of claim 6, wherein said paper currency transport means is activated when said feeding tray optical sensor signals that said paper currency is waiting to be counted.

8. The apparatus of claim 6, wherein said apparatus also includes a manual stop button.

* * * * *